US006433621B1

(12) United States Patent
Smith et al.

(10) Patent No.: US 6,433,621 B1
(45) Date of Patent: Aug. 13, 2002

(54) BIAS CURRENT SOURCE WITH HIGH POWER SUPPLY REJECTION

(75) Inventors: Gregory J. Smith; Yinming Chen, both of Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/829,617

(22) Filed: Apr. 9, 2001

(51) Int. Cl.[7] ..... G05F 1/10; G05F 3/02

(52) U.S. Cl. ..... 327/538; 327/539; 327/542; 323/315

(58) Field of Search ..... 327/538, 539, 327/540, 541, 542, 543; 323/312, 315

(56) References Cited

U.S. PATENT DOCUMENTS 4,785,231 A * 11/1988 Bohme et al. ..... 323/315
4,978,868 A * 12/1990 Giordano et al. ..... 323/316
6,124,754 A * 9/2000 Afghahi ..... 323/315
6,150,872 A * 11/2000 McNeill et al. ..... 323/313
6,181,195 B1 * 1/2001 McIntyre ..... 323/316

* cited by examiner

*Primary Examiner*—Terry D. Cunningham
*Assistant Examiner*—Quan Tra
(74) *Attorney, Agent, or Firm*—Wagner Murabito & Hao LLP

(57) ABSTRACT

A bias current source circuit with high power supply rejection. In one embodiment, the present invention is comprised of a bias current source circuit. The bias current source circuit is comprised of a primary current source coupled to a power supply, a secondary current source for biasing the primary current source and also coupled to the power supply, and a gain stage. In the present embodiment, the primary current source includes a first transistor having a first region coupled to a second resistor and a second transistor having a first region coupled to the second resistor. In the present embodiment, the gain stage includes a first input coupled to the second region of the first transistor. The simple gain stage further includes a second input coupled to the second region of the second transistor. The gain stage also includes an output coupled to the first regions of the first and second transistors.

20 Claims, 3 Drawing Sheets

BIAS CURRENT SOURCE WITH HIGH POWER SUPPLY REJECTION

FIELD OF THE INVENTION

The present invention relates to current source as it relates to an integrated circuit. More particularly, the present invention relates to current sources designed to provide rejection of high power supply voltages.

BACKGROUND OF THE INVENTION

Portable and low power consumption electronic devices such as, e.g., laptop computers, personal digital assistants (PDAs), cellular telephones, and the like, are requiring less and less power to operate. This is due, in part, to the continued advancement in computer and electronic technology, with attention to the design and manufacturing of the components used in the construction of the low power consuming devices. These new low power devices have become more and more powerful such that they are now able to perform processing tasks previously associated with desktop and workstation computers.

However, the circuitry and components implemented in these low power consuming devices is of a design usually implemented in high power consumption devices such as, e.g., engineering workstations and desktop computer systems. In a low power consuming device, this amount of voltage would cause serious damage to the components and circuits contained therein.

Therefore, because the circuitry and components are not particularly well suited for implementation in low power consuming devices, modification of the existing components and circuits or entirely new designs are necessary. Additionally, it is advantageous to provide a current source that is relatively constant and highly insensitive to changes in supply.

One such component associated with most devices, whether high power consumption devices or low power consumption devices like those mentioned above, is the current source. The current source is an important component in circuits.

FIG. 1 shows a conventional current source 1000 commonly used in many of today's circuits. Transistor 400 is the bias transistor and has an emitter coupled to resistor 200, a base coupled to voltage bias node 800, and a collector coupled to bias current output 600. Current flow through transistor 400 is indicated by arrow 401. Resistors 100 and 200 are coupled to the power source, Vdd, 900. Diode 300 has its anode side coupled to resistor 100 and its cathode side coupled to voltage bias node 800. The voltage bias node 800 is coupled to the base of transistor 400. Current source 500 is coupled to output node 800 and ground 700. Current flow at current source 500 is indicated by arrow 501.

Still referring to the circuit FIG. 1, it is known that the most dominant error source in circuit 1000 was that when the supply changed, transistor 4 reacted to that change. In this figure, when power supply 900 changes, the collector emitter voltage of transistor 400 will vary with the change in supply. The voltage at node 800 is established through resistor 100 and diode 300 to bias transistor 400. Because the power supply 900 may vary, and circuit 1000 is susceptible to change in the supply, this circuit does not provide the relative stability needed for use with low power consuming devices. This is reflected in the following equations.

Where Ic1=f(Vce1), Vbe=constant, Vt=kT/Q are given, and where,

Ic1 is the collector current of transistor 400

Vbe is the base emitter voltage of transistor 400

Vt is the result of the diode equation from above

Vce1 is the collector emitter voltage of transistor 400

V1 is the load voltage at bias voltage 600

Va is the early voltage of transistor 400

Vdd is power supply 900

R1 is emitter resistor 100

R2 is emitter resistor 200

Is is the current source 500

Isat is the saturation current of diode 300 and transistor 400

The collector current of transistor 400 is:

$$Ic1=Isat\ \exp(Vbe/Vt)(1+Vce1/Va) \qquad 1)$$

where Vce=Vdd−V1−(Ic1*R2)

Inserting Vce into equation 1, we obtain $$Ic1=Isat\ \exp(Vbe/Vt)[1+((Vdd-V1-Ic1*R2)/Va) \qquad 2)$$

Assuming Va=20, V1=1V, and Vdd changed from 2 to 6 volts, current Ic will approximately change 20%.

Therefore, as shown in the equations above, current source 1000, designed originally for use in a high power consuming device, is not particularly well suited for implementation in a low power consuming device which requires a relatively stable current source. This is due, in part, to the fact that the current of traditional current sources has low power supply rejection because of early voltage. While advancement in BJT (bi-polar junction transistor) technology has been directed toward shallower 3unctions, which therefore has lower Va (early voltage) result, it is still susceptible to a change in supply. In attempt to provide a circuit more insensitive to a change in supply than circuit 1000, a cascode current device was introduced.

A cascode current device, historically, is a commonly used cure all to increase a circuit's immunity to change in power supply voltage. A cascode current device is a series transistor, and, in the prior art FIG. 1, would be disposed between transistor 400 and bias current output 600. The cascode current device would have the effect of reducing the dependency of the circuit on power supply 900, Vdd, such that the reaction of transistor 400 to those changes in Vdd is reduced, thereby becoming more stable.

However, the cascode device is not without drawbacks. Because the cascode current device is a series transistor, and as such requires power, additional voltage must be added to the supply voltage to account for the voltage dropped across the cascode current device. Because the cascode current device requires the minimum power supply voltage to be increased, this is contradictory to the requirements of a low power consuming device or circuit.

Additionally, another drawback is that the cascode current device requires additional real estate within the component or device in which it will be implemented. This might not be possible due to the component's or device's limited amount of available physical space which could therefore require a complete redesign of the device or component.

Thus, a need exists for a current source circuit that can operate at low power supply voltage levels, such as those down to one volt. An additional need exists for a current source circuit that is highly immune to changes in power supply voltage levels. A need also exists for a current source circuit that can compensate for and reject high supply voltages. A further need exists for a current source circuit that requires negligible additional power for proper operation.

SUMMARY OF THE INVENTION

Accordingly, the present invention provides a bias current source for providing high power supply rejection. The present invention further provides a bias current source for use in low power consumption markets. The present invention additionally provides a highly stable bias current source.

The present invention provides a bias current source circuit with very high power supply rejection even with very low Va (early voltage). In one embodiment, the present invention is comprised of a bias current source circuit. The bias current source circuit is comprised of a primary current source coupled to a power supply, a secondary current source for biasing the primary current source and also coupled to the power supply, and a simple gain stage amplifier. In the present embodiment, the primary current source includes a first transistor having a first region coupled to a second resistor and a second transistor having a first region coupled to the second resistor. In the present embodiment, the gain stage amplifier includes a first input coupled to a second region of the first transistor. The gain stage amplifier further includes a second input coupled to a second region of the second transistor. The gain stage amplifier also includes an output coupled to the first regions of the first transistor and the second transistor.

These and other objects and advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION

A bias current source circuit with high power rejection is described. In the following description, for purposes of explanation, numerous specific details are set forth in order to provide a thorough understanding of the present invention. It will be obvious, however, to one skilled in the art that the present invention may be practiced without these specific details. In other instances, well-known structures and devices are shown in block diagram form in order to avoid obscuring the present invention.

The present invention is discussed primarily in the context of a circuit such as, e.g., an integrated circuit. However, it is appreciated that the present invention can be used with other types of circuits that have the capability to bias current sources in low power consumption devices, including but not limited to current sources with high power rejection.

Figure 1:
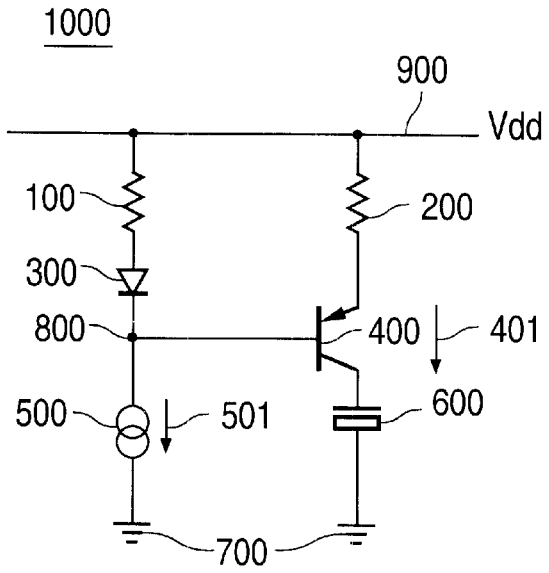
FIGURE 1 (PRIOR ART)
FIG. 1 illustrates a current source circuit design of the prior art.
Figure 2:
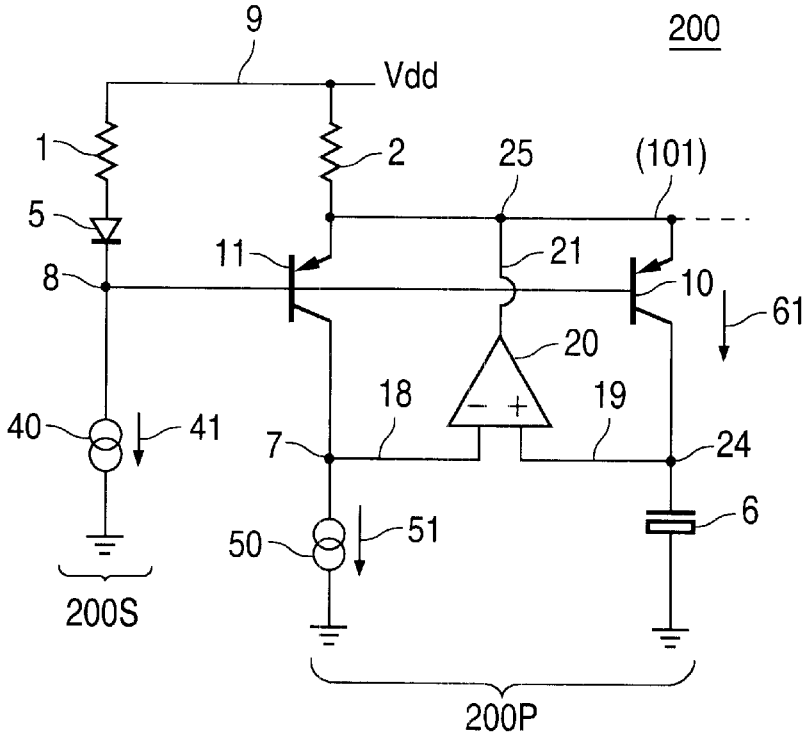
FIG. 2 is an illustration of a bias current source circuit design in accordance with one embodiment of the present invention.

FIG. 2 is an illustration of the basic operation of a bias current source circuit 200 with high power rejection in which embodiments of the present invention can be implemented. Shown is power supply, Vdd, 9. Coupled to power supply, Vdd, 9 is resistor 1 and resistor 2. The anode side of diode 5 is coupled to resistor 1 and the cathode side is coupled to node 8. Node 8 is coupled to the base of a transistor 11 and also coupled to secondary current source 40. The direction of current flow at secondary current source 40 is indicated by arrow 41. Resistor 2, coupled to power supply 9, is coupled to a first region of transistor 11 and a first region of a transistor 10. The inverting (–) input 18 of gain stage 20 is coupled to a second region of transistor 11 at node 7.

It should be appreciated that, within the context of the disclosure, simple gain stage 20 is represented by an operational amplifier to communicate the theory of the operation therein.

Continuing with FIG. 2, the non-inverting (+) input 19 of gain stage 20 is coupled to a second region of transistor 10 at node 24. The output 21 of gain stage 20 is coupled, at node 25, to the first regions of transistor 10 and transistor 11 in a servo loop configuration. This configuration is designed to maintain the voltage potential at node 7 to equal bias voltage 6 at node 24. The base of transistor 10 is coupled to the base of transistor 11. Bias voltage 6 is coupled to a second region of transistor 10 and the non-inverting (+) input 19 of simple gain stage 20 at node 24. A second region of transistor 11 is coupled to primary current source 50 at node 7. The direction of the current flow at primary current source 50 is indicated by arrow 51. The direction of current flow at transistor 10 is indicated by arrow 61. Line 101, in parentheses, is for alignment reference when coupling FIGS. 3C and 3D to FIG. 2, for deriving an output current.

It should be appreciated that in the present embodiment of the present invention, the first region of a transistor is an emitter and the second region of a transistor is a collector. However, in another embodiment, the first region of a transistor could be the collector and the second region could be the emitter. In yet another embodiment, a transistor may consist of drain, source, and gate regions.

Bias current source circuit 200, in this embodiment of the present invention, is comprised of two portions. One portion, to the right, is primary current source 200P which generates current 50 with high supply rejection. The other portion of the present invention, in this embodiment, is secondary current source 200S, to the left, which creates current 40 and depends upon power supply 9 to provide the reference voltage for the bias voltage for transistors 10 and 11. Current source 50 depends upon the primary voltage at node 7.

Still referring to FIG. 2, in operation of bias current source circuit 200, a base voltage is established with the secondary current source for transistor 10 and transistor 11. With the primary loop, the emitter voltage is slightly modulated. In one embodiment of the present invention, power supply, Vdd, 9 changes from an initial low value voltage of, as low as, 1.0 V to a higher value voltage. The base voltage will increase with the power supply voltage without showing a change to the base emitter bias of transistor 10 and transistor 11. However, as transistor 10 and transistor 11 track each other, there is a variation as current due to their early voltage, such that the variation influences the voltage of their emitter to the primary loop of simple gain stage 20.

As power supply, Vdd, 9 is changing from an initial low value voltage of 1.0V to a higher value voltage, transistor 10 and transistor 11 are operating as parallel devices, and as such are mirrored of each other. The collector emitter voltage of transistor 10 is thereby increased. The Vce (collector emitter voltage) of transistor 11 is enabled to assume whatever value is determined by the difference of Ic (collector current) of transistor 11 and primary current 50 multiplied by the finite impedance at node 7. Transistor 10 has a tendency to want to increase the output current in response (being Vbe where held constant), due to the finite Va in the equation for early voltage.

However, as transistor 11 attempts to increase output current in response to the increase in emitter collector voltage, it is prevented from doing so because the current of transistor 11 needs to be equal to the current of the primary current source 50. Gain stage 20 will force transistor 11 to match the current of primary current source 50 by feeding back any difference between the output of transistor 11 and the primary current source 50 back to the emitter of transistor 11. This adjusts the emitter voltage such that transistor 11 is getting rebiased. Transistor 11 is getting a new base emitter voltage to compensate for the tendency of the current to want to increase with a greater supply of voltage.

Still referencing FIG. 2, it should be appreciated that if bias current source 200 is not configured with gain stage (shown as an operational amplifier) 20, the primary voltage at node 7 will vary with a change in power supply 9, such that primary current 50 will therefore be dependent upon power supply 9. By providing simple gain stage 20 in bias current source circuit 200, the primary voltage is forced to be equal to bias voltage 6 and the emitter voltage of transistor 10 and transistor 11 are adjusted to equal the collector current of transistor 11 equal to primary current source current 50. If transistor 10 is equal to transistor 11, the collector current of transistor 10 is equal to the primary current 50 at node 7. Thus, the collector current of transistor 10 is independent of power supply 9.

It should also be appreciated that in FIG. 2, transistors 10 and 11 of bias current source circuit 200 are shown to be bipolar transistors, such as a PNP type transistor. However, in another embodiment of the present invention, transistors 10 and 11 could be a MOS type transistor, such as a D (depletion) or E (enhancement) type p channel MOSFET. It should be further appreciated that in another embodiment, the circuit as shown in FIG. 2 and also in FIGS. 3A and 3B, could be as effective through inversion and utilization of NPN or NMOS devices.

Figure 3A:
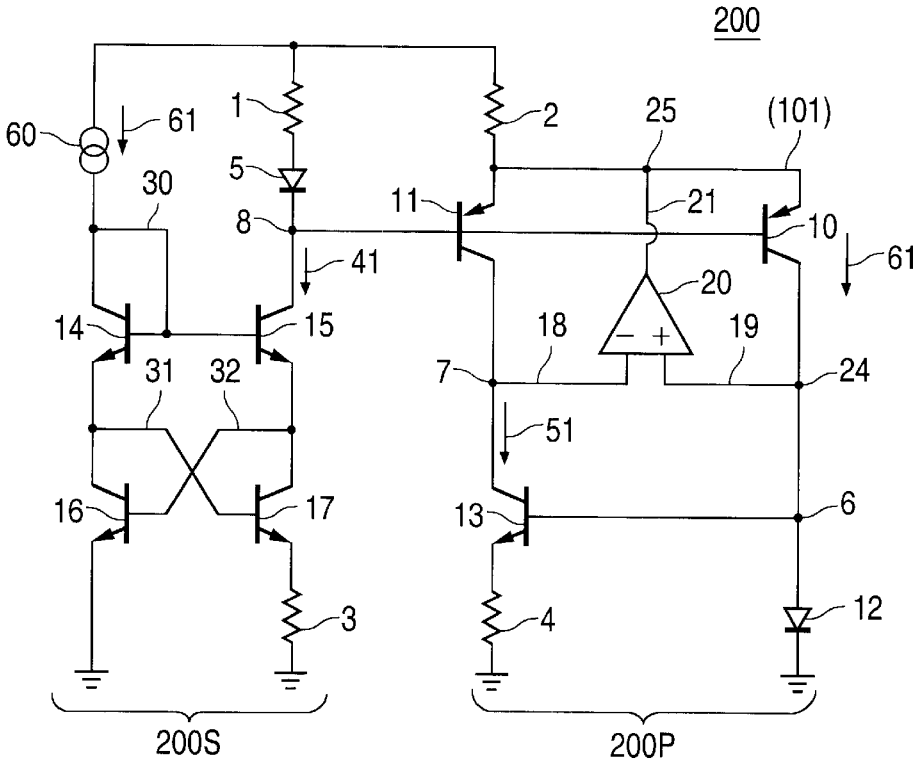
FIG. 3A is a detailed illustration of the bias current source circuit design of FIG. 2, in accordance with one embodiment of the present invention.

FIG. 3A is a detailed circuit illustration of the bias current source circuit 200 of FIG. 2, in one embodiment of the present invention. Functionally analogous to the circuit of FIG. 2, the bias current source circuit 200 of FIG. 3 is comprised of a secondary current source, 200S, shown toward the left, and a primary current source, 200P, shown to the right. Starting from the top left, shown is power supply 9, Vdd. Coupled to power supply, Vdd, 9 is current 60 which, in one embodiment, is a crude current comprised of resistors. The direction of current flow at current 60 is indicated by arrow 62. Also coupled to power supply 9, Vdd, is resistor 1 which is also coupled to the anode side of diode 5. Current 60 is coupled to a second region of transistor 14. The base of transistor 14 is coupled to the base of a transistor 15. The direction of current flow at node 8 is indicated by arrow 41. The bases of transistors 14 and 15 are coupled back to a second region of transistor 14 via loop 30. A second region of transistor 15 is coupled to the cathode of diode 5 at node 8. A first region of transistor 14 is coupled to a second region of a transistor 16. The first region of transistor 14 is also cross-coupled to the base of a transistor 17. A first region of transistor 15 is coupled to a second region of transistor 17. The first region of transistor 15 is also cross-coupled to the base of transistor 16. A first region of transistor 17 is coupled to resistor 3 and resistor 3 is coupled to ground.

Still referring to FIG. 3A, resistor 2 is coupled to power supply, Vdd, 9. Coupled to resistor 2 are a first region of transistor 10 and a first region of transistor 11. The base of transistor 10 is coupled to the base of transistor 11 and the second region of transistor 15 at node 8. A second region of transistor 11 is coupled to a second region of transistor 13 at node 7. A second region of transistor 10 is coupled to bias voltage 6. The direction of current flow at transistor 10 is indicated by arrow 61. The inverting (–) input 18 of gain stage 20 is coupled to both the second region of transistor 11 and the second region of transistor 13 at node 7. The direction of current flow at node 7 is indicated by arrow 51. The non-inverting (+) input 19 of gain stage 20 is coupled to the second region of transistor 10 at node 24. The output of gain stage 20 is coupled, at node 25, to the first regions of transistors 10 and 11, respectively, in a servo loop configuration. This configuration is designed to maintain the voltage potential of node 7 to equal bias voltage 6 at node 24. A first region of transistor 13 is coupled to resistor 4. Diode 12 has an anode side coupled to the second region of transistor 10 and the cathode side is coupled to ground. Line 101, in parentheses, is for alignment reference when coupling FIGS. 3C and 3D to FIG. 3A, for deriving an output current.

It should be appreciated that in the present embodiment of the present invention, the first region of a transistor is an emitter and the second region of a transistor is a collector. However, in another embodiment, the first region of a transistor could be the collector and the second region could be the emitter. In yet another embodiment, a transistor may consist of drain, source, and gate regions.

It should be appreciated that the transistors and the diodes each have an applicable scaling X factor for indicating their particular densities. It should be further appreciated that diodes 5 and diode 12 shown in FIG. 3A may be, in another embodiment, simple transistors, and as such, in the present embodiment, are given scaling X factors as are the transistors. Accordingly, in the current embodiment of the present invention;

transistors 14, 15, and 16, respectively, each have a scaling factor of 1X, meaning they are of an equivalent density and area;

transistors 13 and 17, respectively, each have a scaling factor of 4X, meaning that transistor 13 and 17 are equivalent to each other and are 4 times as large and have one quarter the density of the transistors having a 1X scaling factor;

transistors 10 and 11 are equivalent and each has a scaling factor of 1X; and diodes 5 and 12 are equivalent and each has a scaling factor of 1X.

The secondary current source 40 is what is referred to as a PTAT current source, which is a current proportional to absolute temperature. This is enabled through the biasing of the circuit, which is supported by the following equation. Starting at the emitter of transistor 16, the voltage is 0. Then proceeding up to transistor 15, then over to transistor 14, then down to transistor 17, and then to ground, the sum of all the voltages in that loop must equal zero, as is stated in Kirchoff's voltage law. It is now possible to determine the current at resistor 3 by solving the, following equation:

$$0=VbeQ7+VbeQ6-VbeQ5-VbeQ8-IsR3 \quad (1)$$

where

VbeQ7 is the base emitter voltage of transistor 16

VbeQ6 is the base emitter voltage of transistor 15

VbeQ5 is the base emitter voltage of transistor 14

VbeQ8 is the base emitter voltage of transistor 17

Is is secondary current source 40

R3 is resistor 3

Simplifying, because transistor 14 and transistor 16 have the same current going through them, and they are the same size, both having a scaling factor of 1X, they cancel each other, and reducing equation 1 results in the following equation:

$$0=VbeQ6-VbeQ8-Is*R3 \quad (2)$$

Because we are considering the difference between VbeQ8 and VbeQ6 as the voltage across resistor 3, the difference of the Vbe of Q6 and Q8 is $$VbeQ6-VbeQ8=Vtet*(\text{log of the ratio of current densities}). \quad (3)$$

The current flowing through transistors 15 and 17 is the same, however, they have different densities, as noted by the scaling X factor. Taking into account the difference in densities, and solving for Is, we have equation 4:

$$Is=(PTAT*\log 4)/R3 \quad (4)$$

where

Is is the secondary current 40

PTAT is the current proportional to absolute temperature log 4 is the log of the ratio of current densities R3 is resistor 3

From equation 3, $$Vtet=kT/Q \quad (5)$$

where

Vtet=V thermal kT/Q is derived from diode equation

Combining equations 3, 4, and 5, the following statement can be made $$Is=kT/Q*\log 4/R3 \quad (6)$$

This is representative of the secondary current 40 of FIG. 3A. It should be appreciated that the constants within equation 6 are the logs and Q. The T (temperature) is a variable. This means there is a linear relationship between the current and the temperature. Particularly, at 0 degrees Kelvin, the current is 0. Then, at room temperature, there is a non zero current, and therefore linearly tracks temperature.

Still referring to FIG. 3A, the secondary current source is a basic current source that is commonly used in IC's, and because it is such a simple current source, it is relatively stable. However, when we take the secondary current and try to mirror it through diode 5 and transistor 10 and transistor 11, the secondary current source loses that constant current nature because of the Va (early voltage) of transistor 10.

Now referring to the primary current source 200P, toward the right of bias current source 200 of FIG. 3A, primary current source 200P is a current source analogous to the secondary current source 200S. In primary current source 200P, transistor 13 has, as stated above, a scaling factor of 4X, and diode 12 has a scaling factor of 1X. The current going through transistor 13 and diode 12 is the same, because of transistors 10 and 11 coupled to gain stage 20 in a servo loop configuration forces the same current through transistor 13 and diode 12. It should be appreciated that diode 12, in another embodiment, may be a transistor, and as such, has been assigned an scaling X factor to represent the density of the diode.

To solve for primary current 50, the following equation is utilized.

$$Ip=kT/Q*\log 4/R4 \quad (7)$$

where

Ip is the primary current 50 kT/Q is from the diode equation log 4 is the log of the ratio of current densities R4 is resistor 4

Accordingly, the secondary current 40 flows through the collector of transistor 15 is approximately equal to Is=(Vt ln 4)/R3 where ls is the secondary current source 40,

Vt is the voltage temperature ln 4 is the log' of the ratio of the current densities R3 is resistor 3; which establishes the base voltage of transistor 10 and transistor 11. However, secondary current 40 still depends upon power supply 9, Vdd. Looking at the primary current 50, assume transistors 12 and 13 are identical but different in size. Primary current 50 can be obtained by solving the equation of the base voltage of transistor 13.

$$Vbe12=Ip*R4+Vbe13 \quad (8)$$

where Vbe=Vt*ln (Ic/Is*1/(1+Vce/Va))

If the area of transistor 13 is equal to 4 times the area of transistor 12, Ip=Ic13=Ic12

Rearranging equation 8, we get $$(Vbe12-Vbe13)/R4=(kTQ\ \ln 4)/R4 \quad (9)$$

assuming Vce13=Vce 12

From equation nine, it shows that primary current 50 is independent of power supply Vdd.

The result is two current sources that can be made nearly the same. By design, there must be some voltage injected into resistor 1 and resistor 2 because as PNP transistor 10 changes Vbe in response to the increase in collector emitter voltage, it is necessary to modulate that voltage, Vbe, ever so slightly. An adequate initial voltage drop is required across resistor 2 so that under all extremes, modulation of VR2 (resistor 2 voltage) is available to correct the current of transistor 10 and transistor 11. This is necessary so that the voltage in resistor 2 can be reduced or increased to compensate for the delta of Vbe (base emitter voltage). This ensures that resistor 2 will nearly always have minimum initial voltage, and it was desirable that the two current sources be basically the same current source so that they track each other first order over temperature. This is accomplished by setting the same voltage for resistors 1 and 2.

Over temperature, those voltages should remain in their non-zero but minimum voltage range, which in one embodiment, is about 200 mv across resistors 1 and 2. This is a matter of selecting the resistor value for the anticipated current(s) of the circuit. Making secondary current (Is) and primary current (Ip) nearly the same, this means that resistor 1 and resistor 2 are nearly the same, such that about 200 mv are dropped.

Now, as Vdd changes, in one example, by 5 volts, which is a relatively substantial amount, the circuit corrects for that increased collector emitter voltage that occurs in transistor 10 by changing the Vbe slightly. By including this dynamic range in the design of the circuit, resistor 2 is able to compensate for the change in the collector emitter voltage.

In one embodiment of the present invention, the bias current source circuit has successfully been applied in the sub-bandgap (1.024V) voltage reference LM4140, which is required to operate with low voltage power supply at 1.8 volts. In addition to low voltage supply, the early voltage of the PNP transistors is very low (20 volts).

Figure 3B:
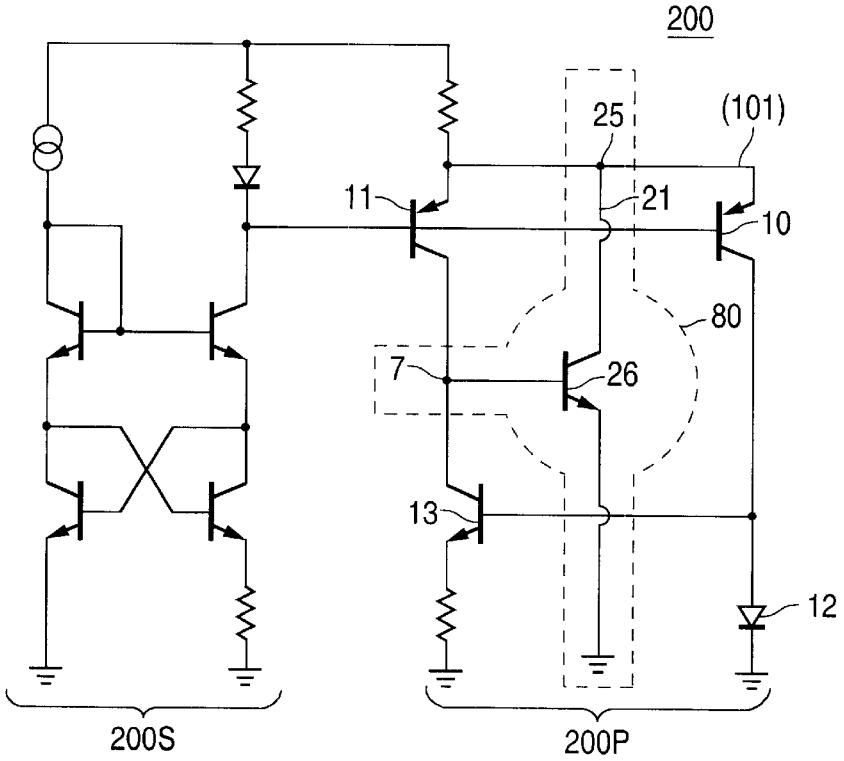
FIG. 3B is an illustration of the bias current source circuit of FIG. 3A in which a transistor is implemented for gain, in another embodiment of the present invention.

FIG. 3B is an illustration of the bias current source circuit 200 of FIG. 3A. In this illustration, the gain stage 20, shown as an operation amplifier in FIG. 3A, has been replaced with a single transistor 26, as indicated by dotted line 80. In this embodiment, transistor 26 has a first region coupled to the emitters of transistors 10 and 11, respectively, a base region coupled to node 7, and a second region coupled to ground. It should be appreciated that transistor 26 is functionally analogous to gain stage 20. This means that the current going through transistor 13 and diode 12 is the same, because of transistors 10 and 11 coupled to transistor 26 in a servo loop configuration which forces the same current through transistor 13 and diode 12. Line 101, in parentheses, is for alignment reference when coupling FIGS. 3C and 3D to FIG. 2, for deriving an output current.

Figure 3C:
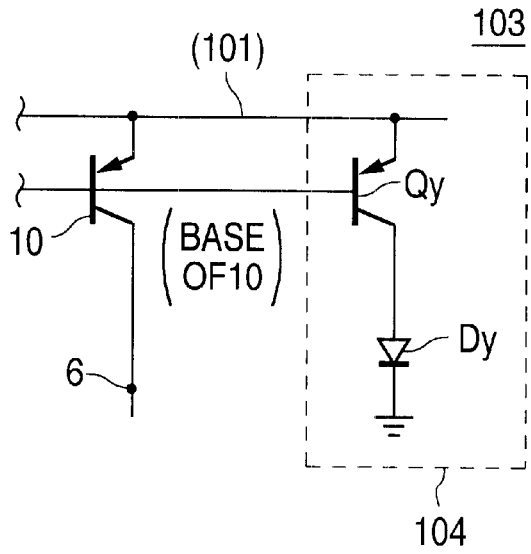
FIG. 3C is an illustration of a diode or Vbe load voltage coupled to the bias current source circuit 200 of FIGS. 2, 3*a,* and 3B.

FIG. 3C is an illustration of a diode or Vbe load voltage 103, as indicated by dotted line 104. Diode or load voltage 103 is necessary to derive an output current from the bias current source circuit 200 of FIGS. 2, 3A, and 3B. Diode or Vbe load voltage 300 is configured as coupled to bias current source circuit 200 of FIGS. 2, 3*a,* and 3B via the base of transistor Qy coupled to the base of transistor 10 (of FIGS. 2, 3A, and 3B). A first region of transistor Qy is coupled to the first region of transistor 10. A second region of transistor Qy is coupled to an anode side of diode Dy and the cathode side of diode Dy is coupled to ground. Line 101, in parentheses, is for alignment reference when coupling FIGS. 3C and 3D to FIGS. 2, 3A, and 3B, for deriving an output current.

Figure 3D:
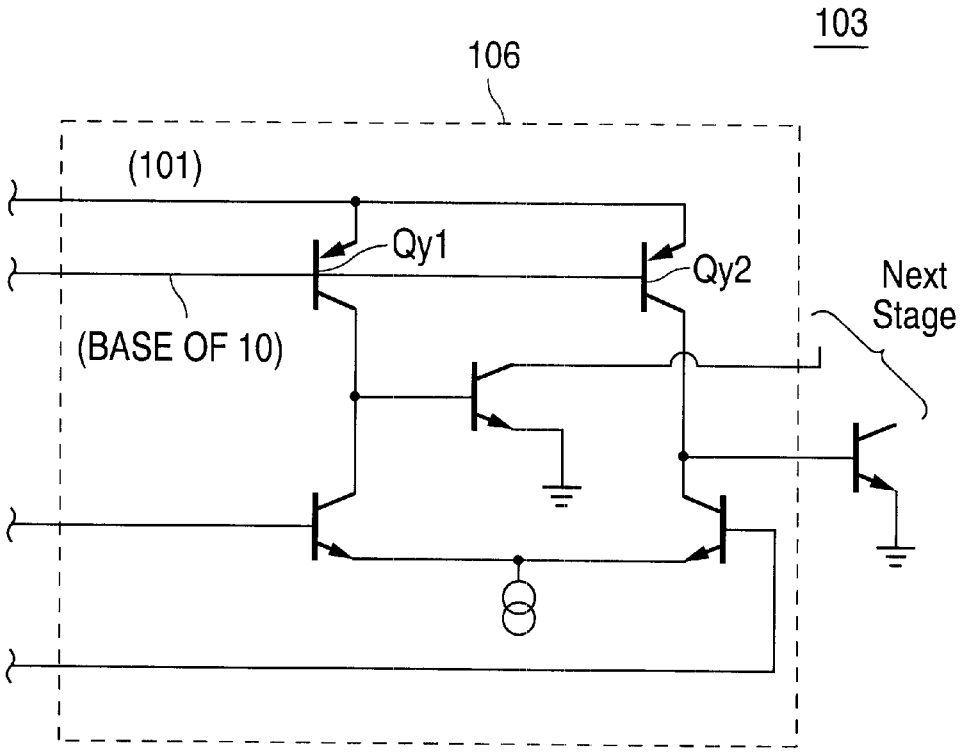
FIG. 3D is a more detailed illustration of the diode or Vbe load voltage of FIG. 3C.

FIG. 3D is a more detailed illustration of the diode or Vbe load voltage 103 of FIG. 3C, as indicated by dotted line 106. It should be appreciated that within the illustration, additional transistors are configured such that an output current can be derived from bias current source circuit 200 of FIGS. 2, 3A, and 3B. Line 101, in parentheses, is for alignment reference when coupling FIGS. 3C and 3D to FIGS. 2, 3A, and 3B, for deriving an output current.

Considering these significant facts, the bias current circuit with high power supply rejection becomes very important to ensure the successful circuit design.

It should be appreciated that in a simulation of the present invention, the simulation resulted in a power supply rejection that was 8.9 ppm/V, where power supply rejection is defined as the difference of the voltage reference delta Vref divided by the voltage reference Vref and the difference of the power supply voltage delta Vdd, such as e.g., delta Vref/Vref*delta Vdd. Without this circuit the power supply rejection was greater than 200 ppm/V. The typical result of the real bandgap reference test is 15 ppm/V.

It should be appreciated that while the present invention is shown implemented as the circuit of FIG. 2, and FIGS. 3A–3B, it is well suited to be implemented in nearly any circuit that is configured to operate at low voltage levels such as, e.g., 1.8 volts, 1.0 volt, and those requiring less than 1.0 volt.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A bias current source circuit comprising:

a power supply;

a primary current source and coupled to said power supply for providing current having:

a first transistor having a first region coupled to a second resistor which is coupled to said power supply;

and a second transistor having a first region coupled to said second resistor and a base coupled with a base of said first transistor;

a secondary current source coupled to said power supply for biasing said primary current source; and at least one gain stage having a first input coupled to a second region of said first transistor and having a second input coupled to a second region of said second transistor and having an output coupled to said first region of said first transistor and to said first region of said second transistor, wherein said simple gain stage includes a servo loop configuration.

2. The bias current source circuit of claim 1 wherein said secondary current source comprising:

a first resistor coupled to said power supply; and a diode having an anode side coupled to said first transistor and having a cathode side coupled to said secondary current, said cathode side coupled to a base of said first transistor.

3. The bias current source circuit of claim 1 wherein said first transistor has a base coupled to said secondary current source.

4. The bias current source circuit of claim 1 wherein said second region of said first transistor is coupled to said primary current.

5. The bias current source circuit of claim 1 wherein said second region of said second transistor is coupled to a bias voltage.

6. The bias current source circuit of claim 1 wherein said first region of a said transistor is an emitter and said second region of said a transistor is a collector and wherein said second region of a said transistor is an emitter and said first region of a said transistor is a collector.

7. The bias current source circuit of claim 1 wherein said first input of said gain stage is an inverting input and said second input of said gain stage is a non-inverting input.

8. A bias current source circuit comprising:

a power supply;

a primary current source coupled to said power supply for providing current and having:

a first transistor having a first region coupled to a second resistor which is coupled to said power supply;

a second transistor having a first region coupled to said second resistor and a base coupled to a base of said first transistor;

a third transistor having a second region coupled to a second region of said first transistor and a first region coupled to a fourth resistor and a base coupled with a bias voltage, wherein said fourth resistor is coupled to ground; and a second diode having an anode side coupled to said bias voltage and a cathode side coupled to ground;

a secondary current source coupled to said power supply for biasing said primary current source; and at least one gain stage having a first input coupled to a second region of said first transistor and having a second input coupled to a second region of said second transistor and having an output coupled to said first region of said first transistor and to said first region of said second transistor, wherein said gain stage includes a servo loop configuration.

9. The bias current source circuit of claim 8 wherein said secondary current source comprising:

a first resistor coupled to said power supply;

a first diode having an anode side coupled with said first resistor;

a crude current coupled to said power supply;

a fourth transistor having a second region coupled to said crude current;

a fifth transistor having a second region coupled to both a cathode side of said diode and said base of said first transistor, and a base coupled to a base of said fourth transistor;

a sixth transistor having a second region coupled to said first region of said fourth transistor and a first region coupled to ground; and a seventh transistor having a second region to said sixth transistor and a first region coupled to a third resistor, said third resistor coupled to ground.

10. The bias current source circuit of claim 9 wherein said base of said first transistor is coupled with both said cathode side of said first diode and said second region of said fifth transistor.

11. The bias current source circuit of claim 9 wherein said sixth transistor has a base coupled to both said first region of said fifth transistor and said second region of said seventh transistor.

12. The bias current source circuit of claim 9 wherein said seventh transistor has a base coupled to both said first region of said fourth transistor and said second region of said sixth transistor.

13. The bias current source circuit of claim 8 wherein said first region of a said transistor is an emitter and said second region of said a transistor is a collector and wherein said second region of a said transistor is an emitter and said first region of a said transistor is a collector.

14. The bias current source circuit of claim 9 wherein said first region of a said transistor is an emitter and said second region of said a transistor is a collector and wherein said second region of a said transistor is an emitter and said first region of a said transistor is a collector.

15. The bias current source circuit of claim 8 wherein said first input of said gain stage is an inverting input and said second input of said gain stage is a non-inverting input.

16. In a bias current source with high power supply rejection for rejecting high voltage in a low power consumption environment, a bias current source circuit comprising:

a power supply;

a primary current source coupled to said power supply for providing current and having:

a first transistor having a first region coupled to a second resistor which is coupled to said power supply;

a second transistor having a first region coupled to said second resistor and a base coupled to a base of said first transistor;

a third transistor having a second region coupled to a collector of said first transistor and a first region coupled to a fourth resistor and a base coupled with a bias voltage, wherein said fourth resistor is coupled to ground; and a second diode having an anode side coupled to said bias voltage and a cathode side coupled to ground;

a secondary current source coupled to said power supply for biasing said primary current source and having:

a first resistor coupled to said power supply;

a first diode having an anode side coupled with said first resistor; a crude current coupled to said power supply;

a fourth transistor having a second region coupled to said crude current;

a fifth transistor having a second region coupled to both a cathode side of said diode and said base of said first transistor, and a base coupled to a base of said fourth transistor;

a sixth transistor having a second region coupled to said first region of said fourth transistor and a first region coupled to ground; and a seventh transistor having a second region coupled to said sixth transistor and a first region coupled to a third resistor, said third resistor coupled to ground; and at least one gain stage having a first input coupled to a collector of said first transistor and having a second input coupled to a collector of said second transistor and having an output coupled to said first region of said first transistor and to said first region of said second transistor, wherein said gain stage includes a servo loop configuration.

17. The bias current source as described in claim 16 wherein said sixth transistor has a base coupled to both said first region of said fifth transistor and said second region of said seventh transistor.

18. The bias current source as described in claim 16 wherein said seventh transistor has a base coupled to both said first region of said fourth transistor and said second region of said sixth collector.

19. The bias current source circuit of claim 16 wherein said first region of a said transistor is an emitter and said second region of said a transistor is a collector and wherein said second region of a said transistor is an emitter and said first region of a said transistor is a collector.

20. The bias current source as described in claim 16 wherein said first input of said gain stage is an inverting input and said second input of said gain stage amplifier is a non-inverting amplifier.

* * * * *